US005522948A

United States Patent [19]

Sawa et al.

[11] Patent Number: 5,522,948

[45] Date of Patent: Jun. 4, 1996

[54] FE-BASED SOFT MAGNETIC ALLOY, METHOD OF PRODUCING SAME AND MAGNETIC CORE MADE OF SAME

[75] Inventors: Takao Sawa, Kanagawa-ken; Yumiko Takahashi, Saitama-ken, both of Japan

[73] Assignee: Kabushiki Kaisha Toshiba, Kawasaki, Japan

[21] Appl. No.: 217,219

[22] Filed: Mar. 24, 1994

Related U.S. Application Data

[63] Continuation of Ser. No. 915,768, Jul. 21, 1992, abandoned, which is a continuation of Ser. No. 634,536, Dec. 27, 1990, abandoned.

[30] Foreign Application Priority Data

| | | | |
|---|---|---|---|
| Dec. 28, 1989 | [JP] | Japan | 1-339722 |
| Jun. 15, 1990 | [JP] | Japan | 2-155297 |
| Jun. 15, 1990 | [JP] | Japan | 2-155298 |
| Jun. 15, 1990 | [JP] | Japan | 2-155299 |

[51] Int. Cl.[6] ..... H01F 1/147

[52] U.S. Cl. ..... 148/308; 148/307; 420/117; 420/118

[58] Field of Search ..... 148/305, 307, 148/308; 420/117, 118

[56] References Cited

U.S. PATENT DOCUMENTS

| | | | |
|---|---|---|---|
| 4,533,390 | 8/1985 | Sherby et al. | 420/118 |
| 4,881,989 | 11/1989 | Yoshizawa et al. | 148/302 |
| 4,918,555 | 4/1990 | Yoshizawa et al. | 360/125 |
| 4,985,089 | 1/1991 | Yoshizawa et al. | 148/303 |

FOREIGN PATENT DOCUMENTS

| | | | |
|---|---|---|---|
| 0271657 | 6/1988 | European Pat. Off. . | |
| 0361051 | 1/1990 | European Pat. Off. | 148/307 |
| 63-302504 | 12/1988 | Japan . | |
| 1-290744 | 11/1989 | Japan . | |
| 2147608 | 5/1985 | United Kingdom | 148/305 |

OTHER PUBLICATIONS

The Condensed Chemical Dictionary, 8th ed. 1971 pp. 236 & 476.

The Japan Institute Of Metals, Spring Meeting Digest (Yoshizawa Et Al) Mar. 15, 1988 p. 393.

Patent Abstracts Of Japan vol. 12, No. 433 (C–543) (3280) 15 Nov. 1988 & JP–63 161 142 (Mitsui Petrochem Ind Ltd) 4 Jul. 1988.

Patent Abstracts Of Japan, vol. 13, No. 589, (C–670) (3937) 25 Dec. 1989 & JP–1 247 555 (Hitachi Metals Ltd.) 3 Oct. 1989.

*Primary Examiner*—John Sheehan

*Attorney, Agent, or Firm*—Oblon, Spivak, McClelland, Maier & Neustadt

[57] ABSTRACT

An Fe-based soft magnetic alloy is consisted essentially of fine crystal grains constituting 50% or more of the alloy structure by area %. The Fe-based soft magnetic alloy has the composition substantially represented by the general formula: $Fe_{100-a-b-c-d-e-f}X_aM_bM'_cA_dSi_eZ_f$ (wherein X is at least one compound selected from the ceramic materials fusible when the composition is fused and rapidly quenched to form a rapidly cooled alloy, M is at least one element selected from the group consisting of Ti, Zr, Hf, V, Nb, Ta, Cr, Mo and W, M' is at least one element selected from the group consisting of Mn, elements in the platinum group, Ag, Au, Zn, Al, Ga, In, Sn, Cu and rare each elements, A is at least one element selected from among Co and Ni, Z is at least one element selected from the group consisting of B, C, P and Ge. Said a, b, c, d, e and f respectively satisfy $0.1 \leqq a \leqq 5$, $0.1 \leqq b \leqq 10$, $0 \leqq c \leqq 10$, $0 \leqq d \leqq 40$, $5 \leqq e \leqq 25$, $2 \leqq f \leqq 20$, $12 \leqq e+f \leqq 30$, provided that all the numerals in the said formulae are in terms of atomic %). The inorganic compound represented by X of the above general formula makes the precipitating crystal grains super fine, thereby reducing dependence of the soft magnetic properties on the heat treatment temperature.

14 Claims, 5 Drawing Sheets

AS QUENCHED
580°C
• Fe-SOLID SOLUTION HAVING A bcc STRUCTURE
20
30
40
50
60
70
80
90
100
110
2θ (deg)
DIFFRACTION INTENSITY

FE-BASED SOFT MAGNETIC ALLOY, METHOD OF PRODUCING SAME AND MAGNETIC CORE MADE OF SAME

This application is a Continuation of application Ser. No. 07/915,768, filed on Jul. 21, 1992, now abandoned, which is a continuation of Ser. No. 07/634,536, filed Dec. 27, 1990, (Now abandoned).

BACKGROUND OF THE INVENTION

1. Field of the Invention

The present invention relates to an Fe-based soft magnetic alloy suitable as materials for use in magnetic cores of various transformers and saturable reactors, various choke coils, various magnetic heads and the like and suitable as magnetic materials for use in various sensors and the like and a method of producing the same.

2. Description of the Related Art

For example, conventionally used as the magnetic materials for various magnetic parts in power supplies and magnetic heads have been mainly Permalloy, Fe-Al-Si alloy, silicon steel, ferrite and the like.

Meanwhile, there have been increasing demands for miniaturization, higher efficiency and the like of electronic equipment and appliances in recent years and, for example switching frequencies of power supplies have been and will be a high frequency in order to meet these requirements. It thus has been desired that the magnetic materials constituting magnetic parts should have improved properties such as low iron loss, high saturation magnetic flux density and the like in the high frequency region.

The above-mentioned materials, however, are not satisfactory as regards these requirements. Amorphous alloys thus have attracted attention recently in their role of the soft magnetic materials meeting the requirements associated with high frequency.

Amorphous alloys show the excellent soft magnetic properties such as high permeability, low coercive force and the like. They also have the properties of low iron loss, high squareness ratio and the like at high frequency. Because of these advantages some of amorphous alloys practically have been used as the magnetic material for switching power supplies. For example, Co-based amorphous alloys have been used for saturable reactors and the like, while Fe-based amorphous alloys for choke coils and the like.

These amorphous alloys also have many problems to solve, however. For example, Co-based amorphous alloys exhibit the excellent properties, having low iron loss, high squareness ratio and the like in the high frequency region. On the other hand, however, they have the disadvantage that they are comparatively high priced and less likely to find wide prevalent use. Fe-based amorphous alloys are reasonably priced and eligible for wide prevalent use. On the other hand, however, they have the disadvantage that they don't acquire zero magnetostriction, their magnetic properties are susceptible to large deterioration due to stress by setting constraction of resin at the time of resin molding and the like and there is a high incidence of noises associated with magnetostriction vibration.

Meanwhile, Fe-based soft magnetic alloys having precipitated super fine crystal grains and the soft magnetic properties comparable to those of Co-based amorphous alloys have been proposed recently (cf. Japanese Patent Laid Open No. 320504/1988). These Fe-based soft magnetic alloys have the excellent soft magnetic properties but also the advantages described below. That is, Since they have low magnetostriction and they are based on Fe, their price is on a comparatively reasonable level. Because of these advantages Fe-based soft magnetic alloys have attracted attention as a magnetic material to replace Co-based amorphous alloys.

However, the above-mentioned Fe-based soft magnetic alloys had a weakness that their magnetic properties have large dependence on the heat treatment temperatures during their production process. That is, in the above-mentioned Fe-based soft magnetic alloys, alloy matrices are once made amorphous and then heat-treated in a range of temperatures close to the crystalization temperature in order to precipitate fine crystal grains. The excellent magnetic properties are generated with precipitation of said fine crystal grains. The range of optimum heat treatment temperatures is narrow, however. Furthermore, a very large amount of energy is discharged at the time crystalization occurs from the amorphous state. These make it highly likely that the heat treatment temperature in the production steps exceeds the prescribed range of temperatures. When the heat treatment temperature exceeds the prescribed range, coarse crystal grains are liable to precipitate and the above-mentioned excellent magnetic properties cannot be obtained.

SUMMARY OF THE INVENTION

Therefore, an object of the present invention is to provide an Fe-based soft magnetic alloy and an Fe-based soft magnetic alloy powder wherein satisfactory low iron loss, high saturation magnetic flux density and low magnetostriction are obtained, these such properties do not have much dependence on the heat treatment conditions and their price is at a reasonable level with the likelihood of wide prevalent use.

Another object of the present invention is to provide a method of producing such Fe-based soft magnetic alloys wherein such production of such Fe-based soft magnetic alloys is well reproducible.

A further object of the present invention is to provide a magnetic core wherein, the price is reasonable, the wide prevalent use is highly likely and the properties such as low iron loss, high saturation magnetic flux density and low magnetostriction and the like in the high frequency region are obtained and well reproducible.

That is, an Fe-based soft magnetic alloy of the present invention is consisted essentially of the composition represented by the general formula:

$$Fe_{100-a-b-c-d-e-f}X_aM_bM'_cA_dSi_eZ_f \quad (I)$$

(wherein X is at least one compound selected from the ceramic materials fusible when the composition is fused and rapidly cooled to form a rapidly quenched alloy, M is at least one element selected from the group consisting of Ti, Zr, Hf, V, Nb, Ta, Cr, Mo and W, M' is at least one element selected from the group consisting of Mn, elements in the platinum group, Ag, Au, Zn, Al, Ga, In Sn, Cu and rare earth elements, A is at least one element selected from the group consisting of Co and Ni and Z is at least one element selected from the group consisting of B, C, P and Ge. Said a, b, c, d, e and f respectively satisfy $0.1 \leqq a \leqq 5$, $0.1 \leqq b \leqq 10$, $0 \leqq c \leqq 10$, $0 \leqq d \leqq 40$, $5 \leqq e \leqq 25$, $2 \leqq f \leqq 20$, and $12 \leqq e+f \leqq 30$ provided that all the numerals in the above-mentioned formulae are in terms of atomic %. The same will apply below.) having fine crystal grains in the alloy structure. The above-mentioned Fe-based soft magnetic alloy consists of said fine crystal grains occupying, for example 50% or more of the structure thereof (area ratio). The powder form of the above-mentioned alloy is an Fe-based soft magnetic alloy powder of the present invention.

Furthermore, the method of producing the Fe-based soft magnetic alloy of the present invention comprises a step of rapidly quenching a melt containing an Fe-based alloy and a ceramic material both in a fused state and a step of heat-treating the rapidly quenched alloy of the said rapid quenching step at a temperature close to or higher than the crystalization temperature of the said rapidly quenched alloy and precipitating fine crystal grains in the alloy structure. Furthermore, the magnetic core of the present invention is made by winding or laminating ribbons of said Fe-based soft magnetic alloy or compressing said Fe-based soft magnetic alloy powder into a molded dust core.

BRIEF DESCRIPTION OF THE DRAWINGS

FIG. 2 (*b*) is a graph showing an X-ray diffraction pattern of the alloy ribbon subjected to the optimum heat treatment with respect to one embodiment of the present invention.

DESCRIPTION OF THE PREFERRED EMBODIMENTS

Figure 1:
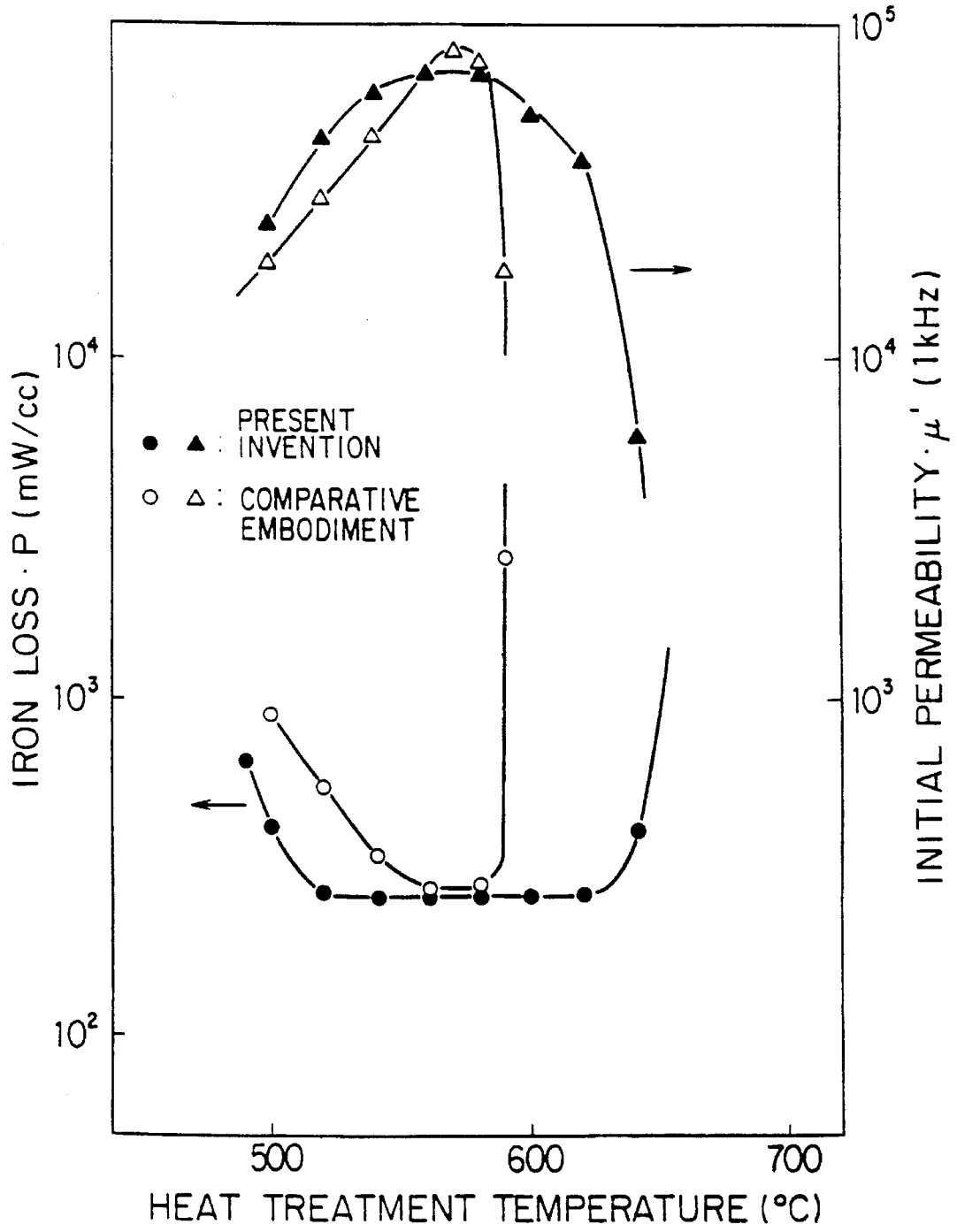
FIG. 1 is a graph showing the relations between the heat treatment temperature and the magnetic properties of the magnetic core with respect to one embodiment of the present invention, in comparison with those of the conventional embodiments.

Next, the present invention will be described in detail below.

The Fe-based soft magnetic alloy and the Fe-based soft magnetic alloy powder of the present invention have the composition represented by the formula (I) set forth above. The reasons for limiting the composition of the formula (I) will be explained below.

X of the said formula (I) is indispensable to precipitate fine crystal grains by the heat treatment at a comparatively low temperature and prevent said crystal grains from becoming coarse. Due to these, such magnetic properties as iron loss, permeability and the like are improved. Furthermore, as the crystal grains are made finer, the soft magnetic properties reduce their dependence on the heat treatment temperature and are made better reproducible.

The said effects are obtained when X is a ceramic material at least fusible when a rapidly quenched alloy is produced in the production process thereof, that is, an inorganic compound. Taking into consideration fusibility of the ceramic material, an inorganic compound with the melting point ranging from 750° C. to 1450° C. is preferable. Likewise taking into consideration uniformity of the melt of alloy except for X when it is fused, a compound satisfying $0.6\ Da \leqq Dc \leqq 1.3\ Da$ is preferable, provided that Dc is the density of X and Da is that of the alloy except for X. Considering these points, an oxide is well suited for the above-mentioned ceramic material. The said oxide includes Cuo, $Cu_2O$, $SnO_2$, $Bi_2O_3$, $MoO_3$, $GeO_2$, and CdO. Because the melting points of $Cu_2O$ and CuO are close to those of mother alloy, conditions for very rapidly quenching are same and thereby they are preferable.

X starts taking these effects when its content is close to 0.1 atomic %. But when it exceeds 5 atomic %, saturation magnetic flux density lowers. When it exceeds 3 atomic %, the alloy is brittle, hard to form a long piece of ribbon on the rapid cooling of the production process. Therefore, X content is a range from 0.1 atomic % to 5 atomic %. The more preferable content of X is a range from 0.3 atomic % to 3 atomic %.

The M element to be selected from the group consisting of Ti, Zr, Hf, V, Nb, Ta Cr Mo and W inhibits crystal grains from becoming coarse as so does X, preventing from precipitation the magnetic property-deteriorating compounds, for example $Fe_2B$ or $Fe_{23}B_6$ in the case where Z is boron. When the alloy is made in the air, particularly Nb, Ta, Mo, W, and V are preferable from among the above-mentioned M elements, because a ribbon can be formed without inert gas arround an injection part.

A M element starts taking these effects when its content is close to 0.1 atomic %. When it exceeds 10 atomic %, the alloy is hard to become amorphous. Thus, the content of the M element is a range from 0.1 atomic % to 10 atomic %. More preferable content of the M element is a range from 0.5 atomic % to 8 atomic %.

Selected from the group consisting of Mn, Ag, Au, Zn, Al, Ga, In, Sn, Cu and the like, elements in the platinum group such as Pt, Ru, Rh, Pd, Ir and rare earth elements such as Y, La, Ce, Nd, Gd, Tb, a M' element is effective in further improving the soft magnetic properties of the alloy having precipitated fine crystal grains.

When the content of M' is too much, however, saturation magnetic flux density lowers and its content is 10 atomic % or less, preferably 8 atomic %.

Among the above-mentioned M' elements, those in the platinum group are effective in improving corrosion resistance, while Al and Ga are effective to stabilize Fe-solid solutions having a bcc structure which are the main phase of fine crystal grains.

Of the above-mentioned M' elements, Cu helps fine crystal grains in precipitating at a low temperature and prevents them from becoming coarse as a X compound does so. For this reason, Cu may be contained in the alloy on top of a M' element set forth above. In this case, the preferred content of Cu is a range from 0.1 atomic % to 5 atomic %. The more preferable content thereof is a range from 0.3 atomic % to 4 atomic %. The total content of the M' elements including Cu is 10 atomic % or less, however.

Considering the above-mentioned addition thereto of Cu, the Fe-based soft magnetic alloy of the present invention has the composition represented by the following general formula $$\text{General formula: } Fe_{100-a-b-d-e-f-g-h}\ X_aM_bM''_gCu_hA_dSi_eZ_f \qquad \text{(II)}$$

(wherein M" is at least one element selected from the group consisting of elements in the platinum group, Ag, Au, Zn, Al, Ga, In, Sn and rare earth elements. Said g and h respectively satisfy $0.1 \leqq h \leqq 5$, $g+h \leqq 10$, provided that all the numerals in the said formulae are in terms of atomic %. The same will apply below).

Furthermore, a part of Fe may be substituted by an A element selected from Co and Ni. When the amount of substitution is too much, however, the soft magnetic properties deteriorate on the contrary and the preferred amount of said substitution is 40 atomic % or less.

The total content of a M element and a M' element (or M" element and Cu) as set forth above preferably is 15 atomic % or less adding up b and c of the above-mentioned general formula (I). When b+c (or b+g+h) exceeds 15 atomic %, saturation magnetic flux density lowers. Preferably, b+c (or b+g+h) is 10 atomic % or less.

Si and a Z element to be selected from among B, C, P and Ge are indispensable to make amorphous the melt of alloy containing the ceramic (the X compound) in a fused state upon the rapid quenching and to help in precipitation of fine crystal grains. Especially, Si can have a solid solution with Fe, conducive to the reduction of magnetic anisotropy and magnetostriction.

When the content of Si is less than 5 atomic %, it is difficult to get the alloy amorphous. When it exceeds 25 atomic %, the rapid quenching effect is low and comparatively coarse crystal grains are liable to occur. For this reason, the preferred content of Si is a range from 5 atomic % to 25 atomic %. A range from 12 atomic % to 20 atomic % of the Si content is particularly preferable because zero magnetostriction is achieved in that range. Furthermore, when the content of a Z element is less than 2 atomic %, it is difficult to get the alloy amorphous. When it exceeds 20%, the magnetic properties are susceptible to deterioration when crystalization occurs due to the heat treatment. Thus, the preferred content of the Z element is a range from 2 atomic % to 20 atomic %. Of all the above-mentioned Z elements, boron is particularly preferable from the viewpoint of the fact that ribbons are easy to make therewith. Further, the total content of Si and a Z element is a range from 12 atomic % to 30 atomic %. The Si/Z ratio of 1 or more is preferable in order to obtain the excellent soft magnetic properties.

Incidentally, with respect to inevitable impurities such as O, S, N and the like contained in commonplace Fe alloys, it is to be noted that the inclusion thereof in a very small amount does not harm the effects of the present invention and the Fe-based soft magnetic alloy thereof.

The Fe-based soft magnetic alloy and its powder of the present invention having the composition represented by the above-mentioned general formula (I) are consisted of fine crystal grains occupying, for example 50% or more of the alloy structure by area ratio. The said fine crystal grains are uniformly distributed throughout the alloy structure. These fine crystal grains are mainly consisted of an Fe solid solution having a bcc structure and especially when the super lattices are present in a part of them the excellent soft magnetic properties are obtained. The presence of said super lattices can be confirmed by an X-ray diffraction showing a peak assigned to them.

Here follows the reason for the prescription that said fine crystal grains should constitute 50% or more of the alloy structure by area ratio: when fine crystal grains are present in less than 50% by area ratio, the disadvantages are liable to occur, including large magnetostriction, low permeability and high iron loss and the desired soft magnetic properties are hard to obtain. Fine crystal grains preferably constitute a range from 60% to 100% of the alloy structure by area ratio. The ratio of the alloy structure occupied by fine crystal grains, as set forth herein, is measured by the observation of the said alloy structure by a high power instrument (for example, a transmission electron microscope: 200,000 magnifications).

Fine crystal grains present in the Fe-based soft magnetic alloy of the present invention are made super fine with a ceramic material such as oxide, having an average grain diameter as small as, for example 50 nm or less. It is thought that said crystal grains are made super fine because the inorganic compound such as oxide practically cannot have a solid solution with Fe, precipating in the boundary of crystal grains or the triple point formed after the heat treatment and thereby inhibiting the growth of crystal grains.

Furthermore, when the heat treatment is carried out at a temperature higher than that of obtaining the desired soft magnetic properties, the X-ray diffraction shows a pattern assigned to the used ceramic material. When it is fused a part of ceramic material may often be reduced with the X-ray diffraction showing patterns assigned to the so reduced metals. For example, when such a ceramic material as CuO and $Cu_2O$ is reduced to Cu, the X-ray diffraction at 2° (deg.) shows the peaks at 43.3.

In the present invention, it is because crystal grains in the alloy structure are made super fine that the soft magnetic properties reduce their dependence on the heat treatment temperature while the excellent soft magnetic properties are better reproducible. That is, as the diameter of crystal grains is made very smaller, magnetic anisotropy is lower and thus it is possible to alleviate the heat treatment conditions.

Furthermore, substantially it is intended to improve the soft magnetic properties with fine crystal grains and when the average grain diameter exceeds 50 nm the desired soft magnetic properties are not obtained. From the viewpoint of reducing dependence of the soft magnetic properties on the heat treatment temperature as set forth above, the preferred average grain diameter is 20 nm or less. The more preferable average grain diameter is 15 nm or less.

Furthermore, the above-mentioned average grain diameter is calculated on the basis of half the value of the width of the X-ray diffraction peak assigned to the crystal grains mainly consisting of Fe solid solutions having the bcc structure. The result of calculation from half the value of the width of the X-ray diffraction pattern is almost identical to the value determined by measuring the maximum diameter of each grain and averaging them in high magnification micrograph.

Next, the method of producing the Fe-based soft magnetic alloy of the present invention will be explained below.

First, a melt: is made containing the Fe-based soft magnetic alloy and the ceramic material both in a fused state. For the sake of the Fe-based soft magnetic alloy, the composition of the said melt should be prepared to satisfy the composition of the above-mentioned general formula (I).

The said melt is made according to the methods such as (1) In the step of producing the alloy matrix, the ceramic material is mixed as other metal materials are done so to produce the alloy matrix with the composition satisfying that of the above-mentioned general formula (I). Then the said alloy matrix is heated and fused at a temperature higher than the melting point thereof. Or, (2) An alloy matrix is made having the composition of the above-mentioned general formula (I) except for X. The said alloy matrix and the ceramic material are mixed to satisfy the composition of the above-mentioned general formula (I). Then, the mixture is heated and fused at a temperature higher than the melting point of both the said melt and ceramic material. Incidentally, the procedure may be replaced by fusing either alloy matrix or ceramic material ahead of time and putting its fusion into the other to fuse.

Thereafter the said melt is rapidly quenched. As the rapid quenching method, known liquid quenching methods such as a single roll method and a double roll method can be applied. Furthermore, an atomization method, a cavitation method or a rotation liquid spinning method can also be applied to produce the Fe-based soft magnetic alloy powder in an amorphous state. In addition, the rapidly quenched alloys in the shape of ribbon or wire may be heat-treated, made brittle and pulverized or cut.

In the present invention, achieving a good amorphous state in the said rapid quenching step is a preferable prerequisite to the formation of super fine crystal grains. Furthermore, rapidly quenched alloys also can be molded and deformed into many shapes such as plate (ribbon), wire, powder, thin scale and the like according to their use. When rapidly quenched alloys are made in a shape of plate, the preferred plate thickness is a range from 3 μm to 100 μm. When they are in a shape of wire, the preferred wire diameter is 200 μm or less. Furthermore, powdery products can be compressed into such shapes as plate, wire, ball and thin scale according to their use. In Fe-based soft magnetic alloy powder, the preferred major axis thereof is a range from 1 μm to 500 μm. The preferred aspect ratio thereof (major axis/thickness or minor axis) is a range from 5 to 15000.

Thereafter, said rapidly quenched alloys in the amorphous state are subjected to the heat treatment at a temperature close to or higher than the crystalization temperature thereof. Super fine crystal grains chiefly consisted of the Fe-solid solution having the bcc structure are precipitated due to the said heat treatment.

It is preferable that the said heat treatment step should be carried out after the alloys are made in a desired shape in the case where their working accompanied by deformation are necessary to make, for example a wound core.

The said heat treatment can be carried out in such a wide range as from −50° C. to +200° C. of the crystalization temperature of rapidly quenched alloys. When the heat treatment temperature condition is lower than −50° C. of the crystalization temperature, fine crystal grains are hard to precipitate. Further, when the temperature condition exceeds 200° C. of the crystalization temperature, other phases than the Fe-solid solution having the bcc structure are liable to occur.

It is because precipitating crystal grains are made super fine as set forth above that Fe-based soft magnetic alloys satisfying the desired soft magnetic properties can be obtained in the said wide range of heat treatment conditions, and this is one of the important characteristics of the present invention. Fe-based soft magnetic alloys with the excellent soft magnetic properties also are well reproducible due to this characteristic. The practically prescribed temperature is preferably a range from −20° C. to +150° C. of the crystalization of rapidly quenched alloys, in order to forestall such indeterminate factors as unexpected rises of temperature of the heat treatment.

Furthermore, the crystalization temperature of rapidly quenched alloys as set forth in the present invention means the value determined by the measurement comprising temperature elevation at the rate of 10 deg/min.

The heat treatment time should appropriately be prescribed, depending upon the composition of alloys and heat treatment temperature intended for use. Ordinarily, the preferred heat treatment time is a range from 2 minutes to 24 hours. When the heat treatment time is shorter than 2 minutes, it is difficult to precipitate crystal grains sufficiently. Further, when the heat treatment time exceeds 24 hours, other phases than that of the Fe-solid solution having the bcc structure are liable to occur. The more preferable heat treatment time is a range from 5 minutes to 10 hours. Furthermore, the heat treatment may be carried out in many atmospheres, including an inert gas atmosphere nitrogen or argon, vacuum, a reducing atmosphere such as hydrogen, or in the air. Meanwhile, the cooling after the heat treatment may either be rapid cooling or slow cooling and not subjected to any particular restraints.

Furthermore, during the cooling after the heat treatment or after the cooling is complete , a magnetic field may be applied (including the heat treatment in a magnetic field) to Fe-based soft magnetic alloys with precipitated fine crystal grains to change their properties to generate the soft magnetic properties meeting the intended use. For this the magnetic field may be either a direct or alternating current magnetic field, while it may take whichever direction of the axis of a ribbon or the width thereof or the thickness thereof. A rotational magnetic field can be applied as well.

The Fe-based soft magnetic alloys of the present invention have the excellent soft magnetic properties for the high frequency region, well suited as the material of magnetic cores workable at high frequency intended for use in, for example magnetic head, high frequency transformer including that of heavy power supplies, saturable reactor, common mode choke coil, normal mode choke coil, noise filter for high voltage pulses, magnetic switch for laser power sources and the like, or as the magnetic material for use in many sensors such as current sensor, direction sensor, security sensor and the like.

Magnetic cores applying Fe-based soft magnetic alloy of the present invention are exemplified by a wound core of a ribbon made from said alloy having fine crystal grains, a laminated core thereof and the like. A dust core may as well be produced by compressing Fe-based soft magnetic alloy powder.

In the above-mentioned wound or laminated magnetic core, at least one side of the ribbon is coated with an insulating layer to provide insulation between the adjacent layers. The said insulating layer is formed by adhesion of, for example a Mgo or $SiO_2$ powder or application of a metal alkoxide solution or by calcination (the heat treatment aimed at precipitation of crystal grains will do as well). The same effect is obtained by impregnating the ribbon with epoxy resin. Said resin impregnation is effective when a cut core and the like are made. Furthermore, resin impregnation is conducive to not only insulation but also improvement of rust proof or environment resistance or the like.

Furthermore, a ribbon of Fe-based soft magnetic alloy can be wound together with an insulating film to provide insulation between layers. The so insulated magnetic core is good for use in magnetic compression circuits of laser power supplies. Insulating film used herein are exemplified by that of polyimide and polyester or glass fibers or the like. Since, however, ribbons used in the present invention have the excellent soft magnetic properties ordinarily when they are brittle, it is preferable to use films of polyimide.

Furthermore, when magnetic cores, especially wound cores are made, the first and last ends of the winding material are preferably closed. The said end closure is achieved by laser irradiation, local jointing of adjacent layers by spot welding, jointing by heat proof film of polyimide.

In the magnetic dust cores applying Fe-based soft magnetic alloy powder of the present invention, the density of molded shape preferably is made higher by means of compression molding using epoxy and phenol resins and the like as the binder or blasting compression molding or the like. Dust cores with the same properties may otherwise be obtained by compressing the powder in an amorphous state into a molded shape and subjecting it to the heat treatment to precipitate said fine crystal grains. Compression molding and the heat treatment may simultaneously be carried out by means of a hot press. In this case, it is preferable to use as the binder a heat proof and electric insulating material, for example water glass, inorganic polymer, metal alkoxide and the like.

Preferably, the magnetic cores obtained by each of the above-mentioned methods are coated with resin such epoxy resin or stored in a case so as to increase insulation property and prevent environment contamination.

As set forth above, the present invention makes it possible to provide Fe-based soft magnetic alloys and powder thereof satisfactory in terms of low iron loss, high saturation magnetic flux density, low magnetostriction and at a reasonable price level with the likelihood of wide prevalent use. Furthermore, the Fe-based soft magnetic alloys of the present invention acquire their magnetic properties under a wide range of heat treatment conditions, assuring their steadfast supplies. Thus, the Fe-based soft magnetic alloys of the present invention are found useful for various magnetic cores, various magnetic parts for switching power supplies, saturable cores for pulse compression circuits, magnetic heads, various sensors, magnetic shields and the like.

Next, the present invention will be explained below with respect to the embodiments thereof. Such embodiments will help in clearer understanding of the present invention, provided that these such embodiments should not be interpreted to restrict the scope of the present invention.

Embodiment 1

An alloy matrix having the composition represented by $Fe_{73}(Cu_2O)_1Nb_3Si_{14}B_9$ was heated and fused at 1400° C. Thereby, a melt was made containing a Fe-based soft magnetic alloy and a ceramic material both in a fused state. Next, the said melt was rapidly quenched by a single roll method to become amorphous and long pieces of amorphous ribbon of 10 mm in width×18 μm in thickness were obtained. Incidentally the crystalization temperature of the said amorphous ribbon was found to be 507° C. (at the temperature elevating rate of 10 deg/min).

The said amorphous ribbon was wound to produce several toroidal wound cores of 18 mm in outer diameter, 12 mm in inner diameter and 5 mm in height. These several toroidal wound cores were subjected to the heat treatment under various temperature conditions for 1 hour in a nitrogen gas atmosphere, super fine crystal grains were precipitated and magnetic cores were produced.

The assessment of the properties will be described below with respect to above-mentioned Embodiment 1.

Each magnetic core was measured by a U-function meter and a LCR meter with respect to iron loss at a frequency of 100 kHz and magnetic flux density of 2 kG and initial permeability at a frequency of 1 kHz measured at 2 mOe. The relations between the heat treatment and the result of these such measurements are shown in FIG. 1.

Furthermore, for the purpose of comparison with the present invention, amorphous ribbons having the composition of $Fe_{73}Cu_1Nb_3Si_{14}B_9$ were subjected to the heat treatment under the same conditions as those of Embodiment 1, fine crystal grains were precipitated and magnetic cores were produced. The magnetic cores of this comparative embodiment were likewise measured with respect to iron loss at a frequency of 100 kHz and magnetic flux density of 2 kG and initial permeability at a frequency of 1 kHz measured at 2 mOe. The result of these measurements, as related to the heat treatment temperature, is shown in FIG. 1 as well.

As evident from FIG. 1, the magnetic cores of Embodiment 1 obtained low iron loss and high permeability in a wide range of temperatures. On the other hand, the magnetic cores of the comparative embodiment were found obtaining low iron loss and high permeability in a narrow range of optimum heat treatment temperatures. Incidentally, saturation magnetic flux density was 13.2 kG.

Figures 2A, 2B:
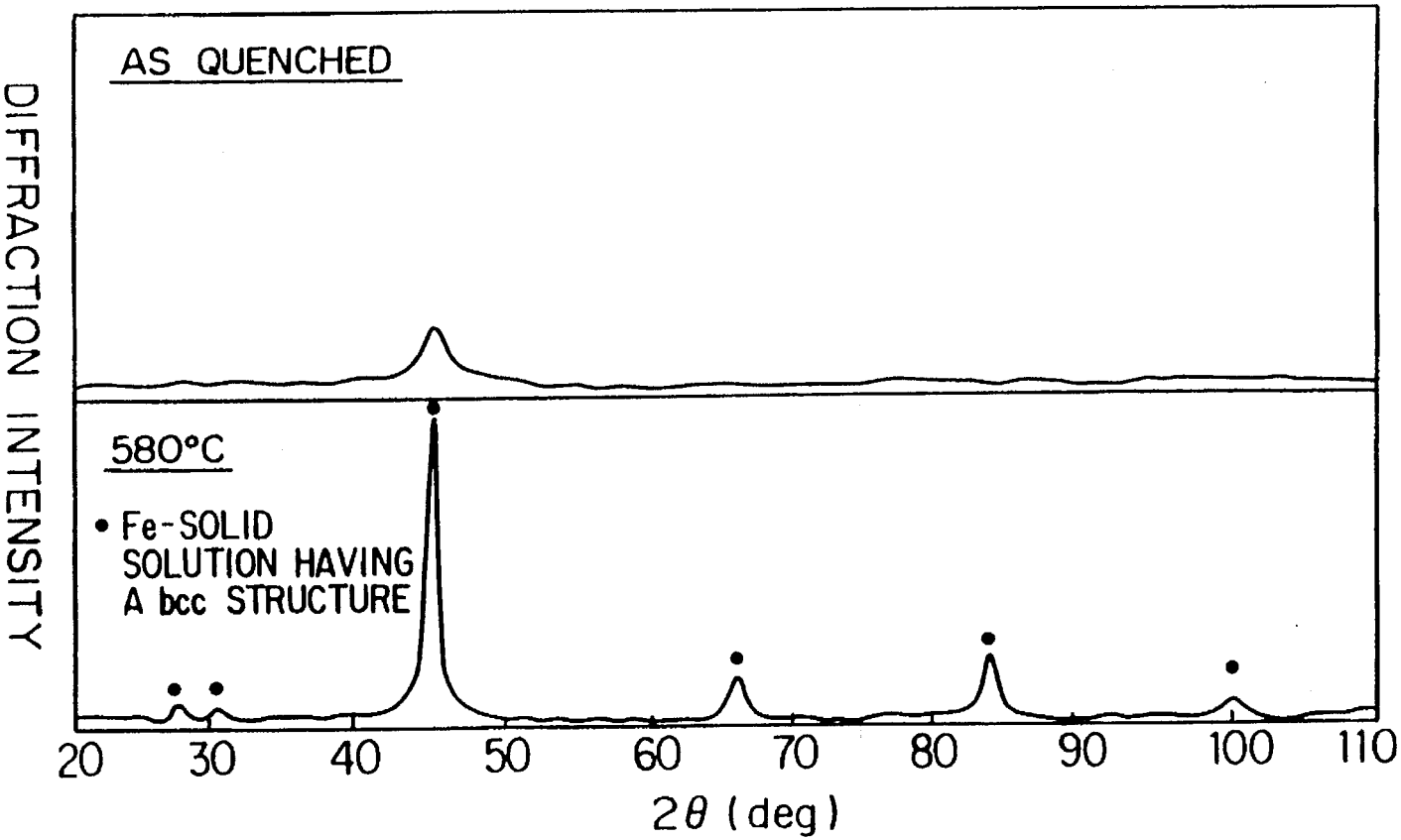
FIG. 2 (*a*) is a graph showing an X-ray diffraction pattern of the alloy ribbon before the heat treatment with respect to one embodiment of the present invention.

Next, X-ray diffraction was measured with respect to one ribbon of the said magnetic cores before (after the rapid cooling) and the other after the heat treatment. The so measured X-ray diffraction patterns are shown in FIG. 2 (before the heat treatment: FIG. 2 (*a*); after the heat treatment: FIG. 2 (*b*)). X-ray diffraction also was measured with respect to still another testing material heat-treated at 650° C. and the pattern assigned thereto is shown FIG. 3.

As evident from FIG. 2, it is definite that the ribbons were in an amorphous state even before the heat treatment. After the heat treatment at 580° C., the X-ray diffraction patterns assigned to Fe-solid solution having the bcc structure alone was observed. Furthermore, the pattern assigned to super lattices also was observed at the side of low diffraction angle as well. On the other hand, with the heat treatment at 650° C., the X-ray diffraction patterns respectively assigned to $Fe_2B$, $Fe_{23}B$, $Cu_2O$ on top of that of the bcc phase were observed, confirming the deterioration of magnetic properties as set forth above.

On the basis of half the value of the width of above-mentioned X-ray diffraction peak, the crystal grain diameter of magnetic cores heat-treated at 580° C. was determined and it was found to be 9.4 nm. The so determined value was almost identical to the value resulting from the measurement by a transmission electron microscope. Further, when the area ratio of fine crystal grains occupying the alloy structure was determined on the basis of high magnification observation of the said alloy structure by a transmission electron microscope (magnification: 200,000), it was found to be 90%.

Furthermore, using a ribbon of the present invention before the heat treatment (after the rapid quenching) and a ribbon of the present invention after the opimum heat treatment, the states of their surface were observed by auger electron spectrometry. The result is shown in FIG. 4.

Figure 5A:
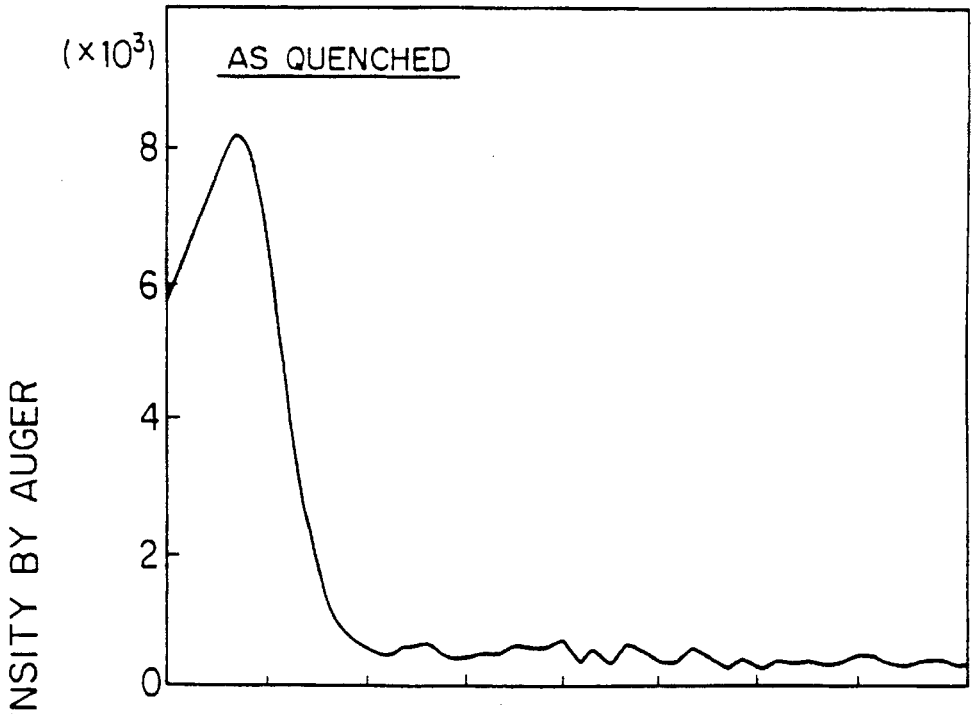
FIG. 5 is a graph showing the state of the surface of the alloy ribbon subjected to the optimum heat treatment which is measured by auger electron spectrometry with respect to the comparative embodiment.
Figure 5B:
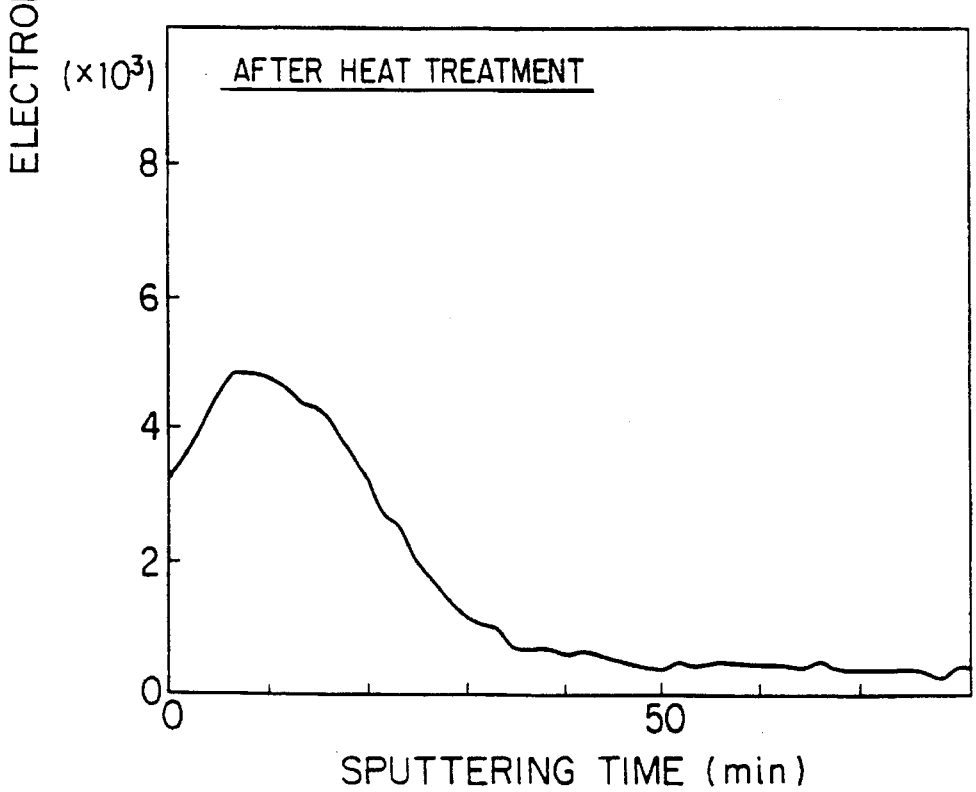

Furthermore, using a ribbon of the above comparative embodiment before the heat treatment of the present invention and a ribbon of the above comparative embodiment after the heat treatment, the states of their surface were observed similarly. The result is shown in FIG. 5.

Furthermore, the measurement was conducted with JUMP10SX, brand of Jeol LTD., applying an electron beam at a rate of accelerating voltage of 10 kV and a current of $1\times10^{-7}$ and ion etching of $Ar^+$ at a rate of accelerating voltage of 3 kV and a current of 30 mA, while the beam was 100 μm in diameter. It was identical to 100 Å/min in the case with $SiO_2$.

Figure 4A:
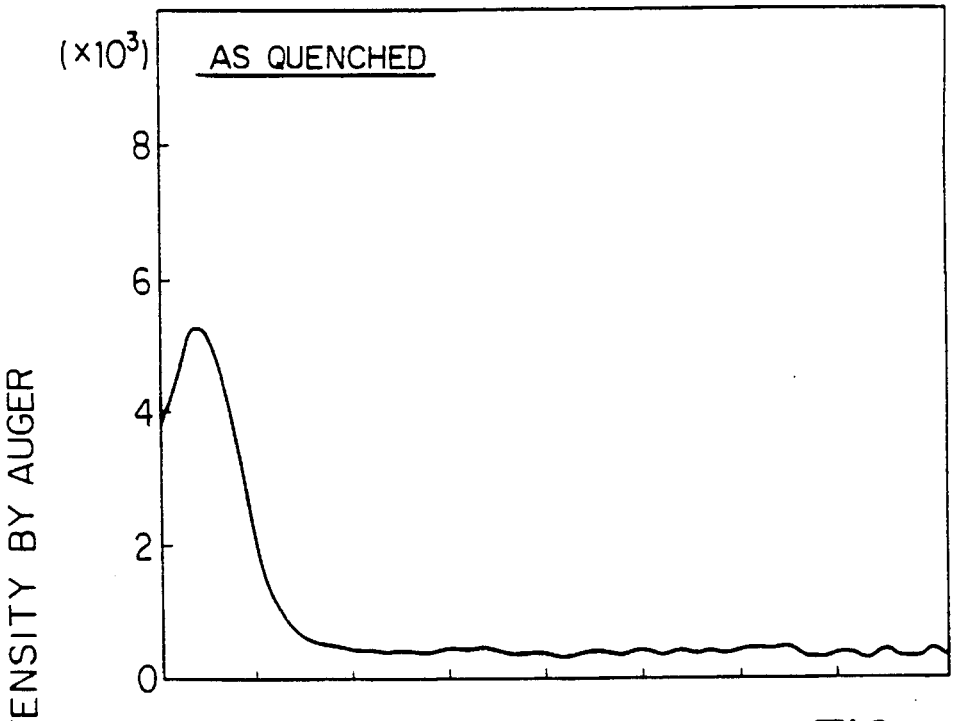
FIG. 4 is a graph showing the state of the surface of the alloy ribbon subjected to the optimum heat treatment which is measured by auger electron spectrometry with respect to one embodiment of the present invention.
Figure 4B:
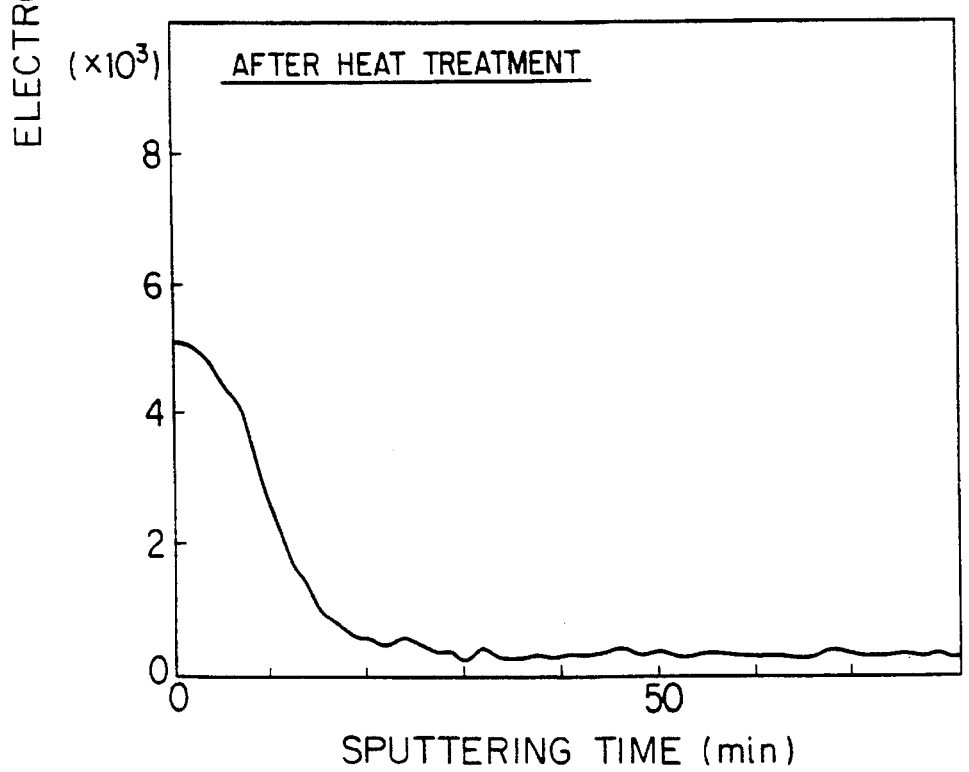

As shown in FIG. 4, the oxygen content determined from the surface remained unchanged before and after the heat treatment in the alloy ribbons of the present invention. As shown in FIG. 5, however, in the case with the alloy ribbons before the heat treatment of comparative embodiment, their oxygen content was found high up to almost 2 times as much depth of their structure as that of the present invention. It is thought that solid oxides were previously present in the alloy ribbons of the present invention, preventing dispersion of oxygen within. Thus, both CuO and Cu were found effective in making crystal grains finer but the effect of CuO greater as it was so shown by the value determined from the X-ray diffraction peak assigned to it. Such oxides held down dispersion of various elements, preventing precipitation of $Fe_2B$, $Fe_{23}B_6$ and the like and expanding the range of optimum heat treatment temperature.

Embodiment 2

An alloy matrix having the composition represented by $Fe_{73}(CuO)_{0.5}(Cu_2O)_{0.5}Nb_3Si_{14}B_9$ was heated and fused at 1400° C. Then the said melt was rapidly quenched according to the same procedure as that of Embodiment 1 and long pieces of amorphous ribbon were obtained The crystalization temperature of these amorphous ribbons was found to be 495° C.

Next, the said amorphous ribbons were wound to produce toroidal wound cores, the so obtained cores were heat-treated under the same conditions as those of Embodiment 1 and magnetic cores were obtained. The assessment of properties was conducted in the same way as that of Embodiment 1 with respect to the said magnetic cores. As the result it was found that the magnetic cores of Embodiment 2 acquired low iron loss and high permeability in a wide range of temperatures as those of Embodiment 1 did so. Further, X-ray diffraction after the heat treatment showed a peak assigned to the Fe-solid solution having the bcc structure alone.

Embodiment 3

Cores wound of amorphous ribbon respectively having each composition shown in Table 1 were produced according to the same procedure as that of respectively Embodiments 1 and 2. Wound cores of each amorphous ribbon were heat-treated at +50° C. of the crystalization temperature thereof for 1.5 hours and magnetic cores were obtained.

The properties of the so obtained magnetic cores (Fe-based soft magnetic alloy ribbon) were assessed in the same way as that of Embodiment 1. The result of the said assessment is shown in Table 1, together with that of assessment of rapidly quenched Sendust ribbons.

TABLE 1

| | Alloy composition | Average grain diameter(nm)*1 | Iron loss (mW/cc)*2 | Magnetostric tion (ppm)*3 |
|---|---|---|---|---|
| Embodiment 3 | $Fe_{73.5}$ $(CuO)_{0.5}$ $Nb_3$ $Si_{14}$ $B_9$ | 10.8 | 250 | 1.4 |
| | $Fe_{73}$ $(CuO)_2$ $Nb_3$ $Si_{14}$ $B_8$ | 10.2 | 240 | 1.0 |
| | $Fe_{73}$ $(CuO)_3$ $Nb_3$ $Si_{14}$ $B_7$ | 10.0 | 250 | 1.0 |
| | $Fe_{73}$ $(CuO)_4$ $Nb_3$ $Si_{13}$ $B_7$ | 9.3 | 235 | 1.8 |
| | $Fe_{73}$ $(CuO)_5$ $Nb_3$ $Si_{13}$ $B_6$ | 8.5 | 230 | 1.9 |
| | $Fe_{73}$ $(CuO)_1$ $Ta_3$ $Si_{14}$ $B_9$ | 10.5 | 270 | 1.8 |
| | $Fe_{73}$ $(CuO)_1$ $Mo_3$ $Si_{14}$ $B_9$ | 10.7 | 270 | 1.8 |
| | $Fe_{73}$ $(CuO)_1$ $W_3$ $Si_{14}$ $B_9$ | 10.9 | 270 | 1.8 |
| | $Fe_{73}$ $(CuO)_1$ $Nb_3$ $Si_{14}$ $B_9$ | 11.2 | 250 | 1.7 |
| | $Fe_{73}$ $(CuO)_1$ $Ti_3$ $Si_{14}$ $B_9$ | 12.1 | 290 | 1.8 |
| | $Fe_{73}$ $(CuO)_1$ $Zr_3$ $Si_{14}$ $B_9$ | 11.9 | 280 | 1.8 |
| | $Fe_{73}$ $(CuO)_1$ $Hf_3$ $Si_{14}$ $B_9$ | 12.1 | 300 | 1.8 |
| | $Fe_{71}$ $(CuO)_1$ $V_7$ $Si_{13}$ $B_8$ | 14.1 | 300 | 1.5 |
| | $Fe_{73}$ $(GeO_2)_1$ $Nb_3$ $Si_{14}$ $B_9$ | 13.5 | 320 | 1.5 |
| | $Fe_{73}$ $(CdO)_1$ $Nb_3$ $Si_{14}$ $B_9$ | 10.7 | 270 | 1.5 |
| | $Fe_{73}$ $(SnO_2)_1$ $Nb_3$ $Si_{14}$ $B_9$ | 10.0 | 250 | 1.5 |
| | $Fe_{73}$ $(CuO)_{0.5}$ $Cu_{0.5}$ $Nb_3$ $Si_{14}$ $B_9$ | 10.3 | 250 | 1.4 |
| | $Fe_{73}$ $(CuO)_1$ $Cu_1$ $Nb_3$ $Si_{14}$ $B_8$ | 11.8 | 240 | 1.0 |
| | $Fe_{73}$ $(CuO)_2$ $Cu_1$ $Nb_3$ $Si_{14}$ $B_7$ | 11.3 | 250 | 1.0 |
| | $Fe_{73}$ $(CuO)_3$ $Cu_1$ $Nb_3$ $Si_{13}$ $B_7$ | 11.0 | 235 | 1.8 |
| | $Fe_{73}$ $(CuO)_4$ $Cu_1$ $Nb_3$ $Si_{13}$ $B_6$ | 10.8 | 230 | 1.9 |
| | $Fe_{73}$ $(CuO)_1$ $Cu_1$ $Ta_3$ $Si_{14}$ $B_8$ | 10.7 | 270 | 1.8 |
| | $Fe_{73}$ $(CuO)_1$ $Cu_1$ $Mo_3$ $Si_{14}$ $B_8$ | 10.5 | 270 | 1.8 |
| | $Fe_{73}$ $(CuO)_1$ $Cu_1$ $W_3$ $Si_{14}$ $B_8$ | 10.8 | 270 | 1.8 |
| | $Fe_{73}$ $(CuO)_1$ $Cu_1$ $Nb_3$ $Si_{14}$ $B_8$ | 11.5 | 250 | 1.7 |
| | $Fe_{72}$ $(CuO)_1$ $Cu_1$ $Ti_5$ $Si_{14}$ $B_7$ | 12.0 | 290 | 1.8 |
| | $Fe_{73}$ $(CuO)_1$ $Cu_1$ $Zr_3$ $Si_{14}$ $B_8$ | 11.8 | 280 | 1.8 |
| | $Fe_{73}$ $(CuO)_1$ $Cu_1$ $Hf_3$ $Si_{14}$ $B_8$ | 11.9 | 300 | 1.8 |
| | $Fe_{71}$ $(CuO)_1$ $Cu_1$ $V_7$ $Si_{13}$ $B_7$ | 13.8 | 280 | 1.5 |
| | $Fe_{73}$ $(GeO_2)_1$ $Cu_1$ $Nb_3$ $Si_{14}$ $B_8$ | 12.6 | 320 | 1.5 |
| | $Fe_{73}$ $(CdO)_1$ $Cu_1$ $Nb_3$ $Si_{14}$ $B_8$ | 12.5 | 320 | 1.5 |
| | $Fe_{73}$ $(SnO_2)_1$ $Cu_1$ $Nb_3$ $Si_{14}$ $B_8$ | 12.2 | 310 | 1.5 |
| | Sendust ribbons | — | 800 | ~0 |

*1: Determined by half the value of the width of the X-ray diffraction peak assigned to the crystal grains.
*2: Measured at a condition at f = 100 kHz and B = 2 kG.
*3: Measured by a strain gauge.

As evident from Table 1, each Fe-based soft magnetic alloy ribbon of Embodiment 3 had super fine crystal grains. Further, it is definite that magnetic cores produced therefrom acquired low iron loss and low magnetostriction.

Embodiment 4

Cores wound of amorphous ribbons respectively having each composition shown in Table 2 were produced according to the same procedure as that of respectively Embodiments 1 and 2. Then, wound cores of each ribbon were heated-treated at +80° C. of the crystalization temperature thereof for 1 hour to produce magnetic cores.

The properties of each of the so obtained magnetic cores (Fe-based soft magnetic alloy ribbon) were assessed in the same way as that of Embodiment 1. The result is shown in Table 2.

TABLE 2

| | Alloy composition | Average grain diameter(nm)*1 | Iron loss (mW/cc)*2 | Magnetostric tion (ppm)*3 |
|---|---|---|---|---|
| Embodiment 4 | $Fe_{70}(Cu_2O)_1Nb_3Ni_3Si_{14}B_9$ | 10.9 | 270 | +1.8 |
| | $Fe_{70}(Cu_2O)_1Nb_3Ni_6Si_{13}B_7$ | 11.0 | 360 | +2.7 |
| | $Fe_{70}(Cu_2O)_1Nb_3Co_3Si_{14}B_9$ | 10.8 | 270 | +2.0 |
| | $Fe_{70}(Cu_2O)_1Nb_3Co_6Si_{13}B_7$ | 11.3 | 370 | +3.0 |
| | $Fe_{73}(Cu_2O)_1Nb_3Al_1Si_{14}B_9$ | 10.8 | 270 | ~0 |
| | $Fe_{73}(Cu_2O)_1Nb_3Ga_2Si_{14}B_7$ | 11.0 | 270 | ~0 |
| | $Fe_{73}(Cu_2O)_1Nb_3Zn_2Si_{14}B_7$ | 11.5 | 290 | ~0 |
| | $Fe_{73}(Cu_2O)_1Nb_3In_1Si_{14}B_8$ | 11.7 | 290 | ~0 |
| | $Fe_{73}(Cu_2O)_1Nb_3Sn_1Si_{14}B_8$ | 11.7 | 290 | ~0 |
| | $Fe_{72}(Cu_2O)_1Ta_3Ru_3Si_{13}B_8$ | 10.3 | 260 | ~0 |
| | $Fe_{73}(Cu_2O)_1Mo_3Ag_1Si_{13}B_9$ | 12.1 | 280 | ~0 |
| | $Fe_{73}(Cu_2O)_1W_3Au_1Si_{14}B_8$ | 9.9 | 260 | ~0 |
| | $Fe_{73}(Cu_2O)_1Nb_3Cr_2Si_{12}B_9$ | 10.5 | 270 | ~0 |
| | $Fe_{73}(CuO)_1Nb_3Mn_2Si_{13}B_8$ | 10.6 | 270 | ~0 |
| | $Fe_{73}(CuO)_1Mo_3Si_{14}B_8C_1$ | 10.8 | 260 | ~0 |
| | $Fe_{73}(CuO)_1Hf_3Si_{14}B_7Ge_2$ | 10.4 | 270 | ~0 |
| | $Fe_{71}(CuO)_1V_7Si_{13}B_5P_3$ | 13.5 | 290 | ~0 |
| | $Fe_{70}(Cu_2O)_1Cu_1Nb_3Ni_3Si_{14}B_8$ | 9.9 | 270 | +1.8 |
| | $Fe_{70}(Cu_2O)_1Cu_1Nb_3Ni_6Si_{13}B_6$ | 10.0 | 360 | +2.7 |
| | $Fe_{70}(Cu_2O)_1Cu_1Nb_3Co_3Si_{14}B_8$ | 9.8 | 270 | +2.0 |
| | $Fe_{70}(Cu_2O)_1Cu_1Nb_3Co_6Si_{13}B_6$ | 10.2 | 370 | +3.0 |
| | $Fe_{73}(Cu_2O)_1Cu_1Nb_3Al_1Si_{14}B_8$ | 9.8 | 270 | ~0 |
| | $Fe_{73}(Cu_2O)_1Cu_1Nb_3Ga_2Si_{14}B_6$ | 10.0 | 270 | ~0 |
| | $Fe_{73}(Cu_2O)_1Cu_1Nb_3Zn_2Si_{14}B_6$ | 10.5 | 290 | ~0 |
| | $Fe_{73}(Cu_2O)_1Cu_1Nb_3In_1Si_{14}B_7$ | 10.7 | 290 | ~0 |
| | $Fe_{73}(Cu_2O)_1Cu_1Nb_3Sn_1Si_{14}B_7$ | 10.7 | 290 | ~0 |
| | $Fe_{72}(Cu_2O)_1Cu_1Ta_3Ru_3Si_{13}B_7$ | 9.3 | 260 | ~0 |
| | $Fe_{73}(Cu_2O)_1Cu_1Mo_3Ag_1Si_{13}B_8$ | 11.1 | 280 | ~0 |
| | $Fe_{73}(Cu_2O)_1Cu_1W_3Au_1Si_{14}B_7$ | 9.9 | 260 | ~0 |
| | $Fe_{73}(Cu_2O)_1Cu_1Nb_3Cr_2Si_{12}B_8$ | 9.5 | 270 | ~0 |
| | $Fe_{73}(CuO)_1Cu_1Nb_3Mn_2Si_{13}B_7$ | 9.6 | 270 | ~0 |
| | $Fe_{73}(CuO)_1Cu_1Mo_3Si_{13}B_8C_1$ | 9.8 | 260 | ~0 |
| | $Fe_{73}(CuO)_1Cu_1Hf_3Si_{13}B_7Ge_2$ | 9.4 | 270 | ~0 |
| | $Fe_{71}(CuO)_1Cu_1V_7Si_{13}B_5P_2$ | 11.6 | 290 | ~0 |

As evident from Table 2, each Fe-based soft magnetic alloy ribbon of Embodiment 4 had super fine crystal grains. Further, it is definite that the magnetic cores therefrom acquired low iron loss and low magnetostriction.

TABLE 3

| | Alloy composition | Average grain diameter(nm)*1 | Iron loss (mW/cc)*2 | Magnetostric tion (ppm)*3 |
|---|---|---|---|---|
| Embodiment 5 | $Fe_{70}(Cu_2O)_1Nb_3Si_{16}B_{10}$ | 9.0 | 420 | −1.5 |
| | $Fe_{71}(Cu_2O)_1Nb_3Si_{15}B_{10}$ | 9.5 | 300 | −1.0 |
| | $Fe_{72}(Cu_2O)_1Nb_3Si_{15}B_9$ | 9.5 | 280 | −1.0 |
| | $Fe_{73}(Cu_2O)_1Nb_3Si_{12}B_{11}$ | 10.4 | 300 | +1.0 |
| | $Fe_{74}(Cu_2O)_1Nb_3Si_{11}B_{11}$ | 11.2 | 350 | +1.5 |
| | $Fe_{70}(CuO)_1Cu_1Nb_3Si_{15}B_{10}$ | 8.8 | 410 | −1.5 |
| | $Fe_{71}(CuO)_1Cu_1Nb_3Si_{15}B_9$ | 9.2 | 290 | −1.0 |
| | $Fe_{72}(CuO)_1Cu_1Nb_3Si_{14}B_9$ | 9.4 | 280 | −1.0 |
| | $Fe_{73}(CuO)_1Cu_1Nb_3Si_{12}B_{10}$ | 9.9 | 290 | +1.0 |
| | $Fe_{74}(CuO)_1Cu_1Nb_3Si_{11}B_{10}$ | 10.2 | 350 | +1.5 |

Embodiment 5

Cores wound of amorphous ribbons respectively having each composition shown in Table 3 were prepared according to the same procedure as that of respectively Embodiments 1 and 2. A wound core of each such amorphous ribbon was heat-treated at +60° C. of the crystalization temperature thereof for 2 hours to produce magnetic cores. The properties of each such magnetic core (Fe-based soft magnetic alloy ribbon) were assessed in the same way as that of Embodiment 1. The result is shown in Table 3.

As is clear from Table 3, each Fe-based soft magnetic alloy ribbon of Embodiment 5 had super fine crystal grains. It is definite that magnetic cores made therefrom had low iron loss and low magnetostriction.

Embodiment 6

An alloy matrix having the composition represented by $Fe_{73}(Cu_2O)_1Nb_3Si_{14}B_9$ was heated and fused at 1350° C.

Thereby, a melt was obtained containing a Fe-based alloy and a ceramic material both in a fused state. Then the said melt was rapidly quenched by a water atomization method to produce amorphous powder having the average grain diameter of 30 μm and the aspect ratio of about 30. The said amorphous powder was found having the crystalization temperature at 507° C. and the saturation magnetic flux density of 13.2 kG.

Next, the so obtained amorphous powder was heat-treated in a vacuum at 580° C. for 1 hour to precipitate super fine crystal grains.

Furthermore, an amorphous powder in a rapidly cooled state was mixed with water glass as the binder. The so obtained mixture was compressed into dust cores by a hot press, super fine crystal grains were made to precipitate and magnetic dust cores were obtained. The heat treatment was carried out in a nitrogen gas atmosphere at 580° C. for 1 hour. The said magnetic dust cores were found having the coercive force of 0.02 Oe. The iron loss was found good at 620 mW/cc measured (by a U-function meter) at a frequency of 100 kHz and a magnetic flux density of 2 kG.

Furthermore, X-ray diffraction was measured with respect to the said magnetic cores and the powder before the heat treatment (after the rapid quenching), resulting in the same outcome as that of Embodiment 1. When the crystal grain diameter was determined according to half the value of width of the peak shown by X-ray diffraction, it was found to be 9.4 nm. The value was almost identical to the crystal grain diameter measured by a transmission electron microscope. It also was determined by a transmission electron microscope (magnification: 200,000) that fine crystal grains constituting the alloy structure had the area ratio of 90%.

It should be noted that heat-treated powder acquired these same properties as well.

Embodiment 7

Melts of alloy respectively having each composition shown in Table 4 were rapidly quenched by a single roll method. Then, each rapidly quenched alloy was heat-treated at 400° C. for 1 hour to become brittle, followed by pulverization thereof by means of a vibration mill and amorphous powder was prepared respectively. Each powder has the aspect ratio of 100 to 1000. Then, each amorphous powder was heat-treated at +60° C. of the crystalization temperature thereof in a nitrogen gas atmosphere for 1.5 hours. Further, magnetic dust cores respectively were produced using an inorganic polymer as the binder and according to the same procedure as that of Embodiment 6.

The properties of each of so obtained Fe-based soft magnetic alloy powder and magnetic dust cores were assessed in the same way as that of Embodiment 6. The result is shown in Table 4, together with the result of the measuring Sendust powder and dust cores made therefrom.

TABLE 4

| | Alloy composition | Average grain diameter(nm)*1 | Iron loss (mW/cc)*2 | Coercive force (Oe) |
|---|---|---|---|---|
| Embodiment 7 | $Fe_{73.5}(CuO)_{0.5}Nb_3Si_{14}B_9$ | 10.8 | 740 | 0.025 |
| | $Fe_{73}(CuO)_2Nb_3Si_{14}B_8$ | 10.2 | 600 | 0.022 |
| | $Fe_{73}(CuO)_3Nb_3Si_{14}B_7$ | 10.0 | 600 | 0.020 |
| | $Fe_{73}(CuO)_4Nb_3Si_{13}B_7$ | 9.3 | 580 | 0.020 |
| | $Fe_{73}(CuO)_5Nb_3Si_{13}B_6$ | 8.5 | 590 | 0.019 |
| | $Fe_{73}(CuO)_1Ta_3Si_{14}B_9$ | 10.5 | 680 | 0.026 |
| | $Fe_{73}(CuO)_1Mo_3Si_{14}B_9$ | 10.7 | 640 | 0.023 |
| | $Fe_{73}(CuO)_1W_3Si_{14}B_9$ | 10.9 | 680 | 0.025 |
| | $Fe_{73}(CuO)_1Nb_3Si_{14}B_9$ | 11.2 | 610 | 0.023 |
| | $Fe_{73}(CuO)_1Ti_3Si_{14}B_9$ | 12.1 | 700 | 0.030 |
| | $Fe_{73}(CuO)_1Zr_3Si_{14}B_9$ | 11.9 | 690 | 0.028 |
| | $Fe_{73}(CuO)_1Hf_3Si_{14}B_9$ | 12.1 | 680 | 0.028 |
| | $Fe_{71}(CuO)_1V_7Si_{13}B_8$ | 14.1 | 660 | 0.030 |
| | $Fe_{73}(GeO_2)_1Nb_3Si_{14}B_9$ | 13.5 | 650 | 0.030 |
| | $Fe_{73}(CdO)_1Nb_3Si_{14}B_9$ | 10.7 | 670 | 0.029 |
| | $Fe_{73}(SnO_2)_1Nb_3Si_{14}B_9$ | 10.0 | 690 | 0.027 |
| | $Fe_{73}(CuO)_{0.5}Cu_{0.5}Nb_3Si_{14}B_8$ | 10.3 | 740 | 0.027 |
| | $Fe_{73}(CuO)_1Cu_1Nb_3Si_{14}B_8$ | 11.8 | 600 | 0.027 |
| | $Fe_{73}(CuO)_2Cu_1Nb_3Si_{14}B_7$ | 11.3 | 600 | 0.025 |
| | $Fe_{73}(CuO)_3Cu_1Nb_3Si_{13}B_7$ | 11.0 | 580 | 0.023 |
| | $Fe_{73}(CuO)_4Cu_1Nb_3Si_{13}B_6$ | 10.8 | 590 | 0.021 |
| | $Fe_{73}(CuO)_1Cu_1Ta_3Si_{14}B_8$ | 10.7 | 680 | 0.023 |
| | $Fe_{73}(CuO)_1Cu_1Mo_3Si_{14}B_8$ | 10.5 | 640 | 0.023 |
| | $Fe_{73}(CuO)_1Cu_1W_3Si_{14}B_8$ | 10.8 | 680 | 0.026 |
| | $Fe_{73}(CuO)_1Cu_1Nb_3Si_{14}B_8$ | 11.5 | 610 | 0.024 |
| | $Fe_{72}(CuO)_1Cu_1Ti_5Si_{14}B_7$ | 12.0 | 700 | 0.030 |
| | $Fe_{73}(CuO)_1Cu_1Zr_3Si_{14}B_8$ | 11.8 | 690 | 0.028 |
| | $Fe_{73}(CuO)_1Cu_1Hf_3Si_{14}B_8$ | 11.9 | 680 | 0.026 |
| | $Fe_{71}(CuO)_1Cu_1V_7Si_{13}B_7$ | 13.8 | 660 | 0.031 |
| | $Fe_{73}(GeO_2)_1Cu_1Nb_3Si_{14}B_8$ | 12.6 | 650 | 0.029 |
| | $Fe_{73}(CdO)_1Cu_1Nb_3Si_{14}B_8$ | 12.5 | 670 | 0.030 |
| | $Fe_{73}(SnO_2)_1Cu_1Nb_3Si_{14}B_8$ | 12.2 | 690 | 0.028 |
| | Sendust cores | — | 1100 | 0.09 |

*1 :Determined by half the value of the width or the X-ray diffraction peak assigned to the crystal grains.
*2: Measured at a condition at f = 100 kHz and B = 2 kG.

As it is evident from the result of measurements shown in Table 4, each Fe-based soft magnetic alloy powder of Embodiment 7 had super fine crystal grains. It is definite that the dust cores made therefrom acquired low iron loss and low coercive force.

Embodiment 8

Amorphous powder respectively having each composition shown in Table 5 was prepared by a cavitation method. Next, each amorphous powder (the aspect ratio of about 50 to 150) was heat-treated at +40° C. of the crystalization temperature thereof in the air for 2 hours. Further, dust cores were respectively prepared using epoxy resin as the binder and according to the same procedure as that of Embodiment 6.

The properties of each of the so obtained Fe-based soft magnetic alloy powder and dust cores made therefrom were assessed in the same way as that of Embodiment 6. The result is shown in Table 5.

TABLE 5

| | Alloy composition | Average grain diameter(nm)*1 | Iron loss (mW/cc)*2 | Coercive force (Oe) |
|---|---|---|---|---|
| Embodiment 8 | $Fe_{70}(Cu_2O)_1Nb_3Ni_3Si_{14}B_9$ | 10.9 | 690 | 0.027 |
| | $Fe_{70}(Cu_2O)_1Nb_3Ni_6Si_{13}B_7$ | 11.0 | 690 | 0.033 |
| | $Fe_{70}(Cu_2O)_1Nb_3Co_3Si_{14}B_9$ | 10.8 | 670 | 0.030 |
| | $Fe_{70}(Cu_2O)_1Nb_3Co_6Si_{13}B_7$ | 11.3 | 690 | 0.036 |
| | $Fe_{73}(Cu_2O)_1Nb_3Al_1Si_{14}B_9$ | 10.8 | 750 | 0.026 |
| | $Fe_{73}(Cu_2O)_1Nb_3Ga_2Si_{14}B_8$ | 11.0 | 740 | 0.024 |
| | $Fe_{73}(Cu_2O)_1Nb_3Zn_2Si_{14}B_7$ | 11.5 | 740 | 0.026 |
| | $Fe_{73}(Cu_2O)_1Nb_3In_1Si_{14}B_8$ | 11.7 | 720 | 0.027 |
| | $Fe_{73}(Cu_2O)_1Nb_3Sn_1Si_{14}B_8$ | 11.7 | 740 | 0.026 |
| | $Fe_{72}(Cu_2O)_1Ta_3Ru_3Si_{13}B_8$ | 10.3 | 690 | 0.028 |
| | $Fe_{73}(Cu_2O)_1Mo_3Ag_1Si_{13}B_9$ | 12.1 | 730 | 0.030 |
| | $Fe_{73}(Cu_2O)_1W_3Au_1Si_{14}B_8$ | 9.9 | 650 | 0.027 |
| | $Fe_{73}(Cu_2O)_1Nb_3Cr_2Si_{12}B_9$ | 10.5 | 690 | 0.024 |
| | $Fe_{73}(CuO)_1Nb_3Mn_2Si_{13}B_8$ | 10.6 | 680 | 0.028 |
| | $Fe_{73}(CuO)_1Mo_3Si_{14}B_8C_1$ | 10.8 | 680 | 0.021 |
| | $Fe_{73}(CuO)_1Hf_3Si_{14}B_7Ge_2$ | 10.4 | 650 | 0.025 |
| | $Fe_{71}(CuO)_1V_7Si_{13}B_5P_3$ | 13.5 | 730 | 0.023 |
| | $Fe_{70}(Cu_2O)_1Cu_1Nb_3Ni_3Si_{14}B_8$ | 9.9 | 690 | 0.028 |
| | $Fe_{70}(Cu_2O)_1Cu_1Nb_3Ni_6Si_{13}B_6$ | 10.0 | 690 | 0.033 |
| | $Fe_{70}(Cu_2O)_1Cu_1Nb_3Co_3Si_{14}B_8$ | 9.8 | 670 | 0.033 |
| | $Fe_{70}(Cu_2O)_1Cu_1Nb_3Co_6Si_{13}B_6$ | 10.2 | 690 | 0.037 |
| | $Fe_{73}(Cu_2O)_1Cu_1Nb_3Al_1Si_{14}B_7$ | 9.8 | 750 | 0.027 |
| | $Fe_{73}(Cu_2O)_1Cu_1Nb_3Ga_2Si_{13}B_7$ | 10.0 | 740 | 0.025 |
| | $Fe_{73}(Cu_2O)_1Cu_1Nb_3Zn_2Si_{14}B_6$ | 10.5 | 740 | 0.026 |
| | $Fe_{73}(Cu_2O)_1Cu_1Nb_3In_1Si_{14}B_7$ | 10.7 | 720 | 0.027 |
| | $Fe_{73}(Cu_2O)_1Cu_1Nb_3Sn_1Si_{14}B_7$ | 10.7 | 740 | 0.027 |
| | $Fe_{72}(Cu_2O)_1Cu_1Ta_3Ru_3Si_{13}B_7$ | 9.3 | 690 | 0.028 |
| | $Fe_{73}(Cu_2O)_1Cu_1Mo_3Ag_1Si_{13}B_8$ | 11.1 | 730 | 0.032 |
| | $Fe_{73}(Cu_2O)_1Cu_1W_3Au_1Si_{14}B_7$ | 9.9 | 650 | 0.030 |
| | $Fe_{73}(Cu_2O)_1Cu_1Nb_3Cr_2Si_{12}B_8$ | 9.5 | 690 | 0.028 |
| | $Fe_{73}(CuO)_1Cu_1Nb_3Mn_2Si_{13}B_7$ | 9.6 | 680 | 0.029 |
| | $Fe_{73}(CuO)_1Cu_1Mo_3Si_{13}B_8C_1$ | 9.8 | 680 | 0.022 |
| | $Fe_{73}(CuO)_1Cu_1Hf_3Si_{13}B_7Ge_2$ | 9.4 | 650 | 0.024 |
| | $Fe_{71}(CuO)_1Cu_1V_7Si_{13}B_5P_2$ | 11.6 | 730 | 0.026 |

As evident from the result of measurements shown in Table 5, each Fe-based soft magnetic alloy powder of Embodiment 8 had super fine crystal grains. It also is definite that dust cores made therefrom acquired low iron loss and low coercive force.

Embodiment 9

Melts respectively having each composition shown in Table 6 were quenched by a rotation liquid spinning method to produce amorphous powder. Then, each amorphous powder (the aspect ratio of about 20 to 50) was heat-treated at +60° C. of the crystalization temperature thereof in a nitrogen gas atmosphere for 2 hours. Meanwhile, dust cores respectively were made using epoxy resin as the binder and according to the same procedure as that of Embodiment 6.

The properties of each of the so obtained Fe-based soft magnetic alloy powder and dust core made therefrom were assessed in the same way as that of Embodiment 6. The result of these measurements is shown in Table 6.

TABLE 6

| | Alloy composition | Average grain diameter(nm)*1 | Iron loss (mW/cc)*2 | Coercive force (Oe) |
|---|---|---|---|---|
| Embodiment 9 | $Fe_{70}(Cu_2O)_1Nb_3Si_{17}B_9$ | 9.0 | 680 | 0.038 |
| | $Fe_{71}(Cu_2O)_1Nb_3Si_{15}B_{10}$ | 9.5 | 670 | 0.026 |
| | $Fe_{72}(Cu_2O)_1Nb_3Si_{15}B_9$ | 9.5 | 630 | 0.022 |
| | $Fe_{73}(Cu_2O)_1Nb_3Si_{12}B_{11}$ | 10.4 | 680 | 0.029 |
| | $Fe_{74}(Cu_2O)_1Nb_3Si_{11}B_{11}$ | 11.2 | 720 | 0.037 |
| | $Fe_{70}(CuO)_1Cu_1Nb_3Si_{15}B_{10}$ | 8.8 | 720 | 0.040 |
| | $Fe_{71}(CuO)_1Cu_1Nb_3Si_{15}B_9$ | 9.2 | 690 | 0.030 |
| | $Fe_{72}(CuO)_1Cu_1Nb_3Si_{14}B_9$ | 9.4 | 640 | 0.024 |
| | $Fe_{73}(CuO)_1Cu_1Nb_3Si_{12}B_{10}$ | 9.9 | 680 | 0.030 |
| | $Fe_{74}(CuO)_1Cu_1Nb_3Si_{11}B_{10}$ | 10.2 | 710 | 0.037 |

As it is clear from the result of measurements shown in Table 6, each Fe-based soft magnetic alloy powder had super fine crystal grains. It also is definite that the dust cores made therefrom had low iron loss and low coercive force.

It has been made evident by every Embodiment as set forth above that the ceramic materials incorporated into the alloys are effective in making finer crystal grains of the Fe-based soft magnetic alloy. Because of super fine crystal grains, it is possible to reduce dependence of the Fe-based soft magnetic alloys having fine crystal grains on the heat treatment temperature. Furthermore, for the same reason, the excellent magnetic properties of the Fe-based soft magnetic alloys can be obtained and are well reproducible.

What is claim is:

1. An Fe-based soft magnetic alloy consisting essentially of a composition having the formula:

$$Fe_{100-a-b-c-d-e-f}X_aM_bM'_cA_dSi_eZ_f$$

wherein X is at least one compound selected from the group consisting of ceramic materials fusible when the composition is fused and rapidly quenched to form a rapidly quenched alloy, M is at least one element selected from the group consisting of Ti, Zr, Hf, V, Nb, Ta, Cr, Mo and W, M' is at least one element selected from the group consisting of Mn, elements of the platinum group, Ag, Au, Zn, Al, Ga, In, Sn, Cu and rare earth elements, A is at least one element selected from the group consisting of Co and Ni, Z is at least one element selected from the group consisting of B, C, P and Ge, and a, b, c, d, e and f respectively satisfy the relations: $0.1 \leqq a \leqq 5$, $0.1 \leqq b \leqq 10$, $0 \leqq c \leqq 10$, $0 \leqq d \leqq 40$, $5 \leqq e \leqq 25$, $2 \leqq f \leqq 20$, $12 \leqq e+f \leqq 30$, these subscript values indicating the atomic percent amounts of the constituent elements of the composition, wherein said alloy comprises an amorphous phase and fine crystal grains consisting essentially of a Fe-solid solution having a bcc structure and having an average diameter of 20 nm or less, said alloy having been prepared by completely fusing the composition of the formula above to form a melt, rapidly quenching the melt, and heat treating the rapidly quenched alloy to form said fine crystal grains.

2. The Fe-based soft magnetic alloy as set forth in claim 1, wherein the said fine crystal grains constitute 50% or more of the alloy structure by area percent.

3. The Fe-based soft magnetic alloy as set forth in claim 1, wherein said fine crystal grains consist essentially of a Fe-solid solution having a bcc structure with at least a portion of said Fe-solid solution being in a super lattice structure.

4. The Fe-based soft magnetic alloy as set forth in claim 1, wherein the compound represented by said X has the melting point ranging from 750° C. to 1450° C. and the density thereof satisfy $0.6\ Da \leqq Dc \leqq 1.3\ Da$, provided that Dc is the density of said X and Da is the density of the alloy composition except for X.

5. The Fe-based soft magnetic alloy as set forth in claim 4, wherein the compound represented by said X is at least one oxide selected from the group consisting of Cuo, CuO, $SnO_2$, $Bi_2O_3$, $MoO_3$, $GeO_2$.

6. The Fe-based soft magnetic alloy as set forth in claim 1, substantially having the composition represented by the formula:

$$Fe_{100-a-b-e-f}X_aM_bSi_eZ_F.$$

7. The Fe-based soft magnetic alloy as set forth in claim 1, substantially having the composition represented by the formula:

$$Fe_{100-a-b-d-e-f-g-h}X_aM_bM''_gCu_hA_dSi_eZ_f$$

wherein M" is at least one element selected from the group consisting of Mn, elements in the platinum group, Ag, Au, Zn, Al, Ga, In, Sn and rare earth elements, said g and h respectively satisfy $0.1 \leqq h \leqq 5$, $g+h \leqq 10$, provided that all numerals in the said formula are in terms of atomic %).

8. The Fe-based soft magnetic alloy as set forth in claim 1, wherein said Fe-based soft magnetic alloy is in powder form.

9. An Fe-based soft magnetic alloy consisting essentially of a composition having the formula:

$$Fe_{100-a-b-c-d-e-f}X_aM_bM'_cA_dSi_eZ_f$$

wherein X is at least one compound selected from the group consisting of ceramic materials having a melting point ranging from 750° C. to 1450° C. and which is fusible when the composition is fused and rapidly quenched to form a rapidly quenched alloy, M is at least one element selected from the group consisting of Ti, Zr, Hf, V, Nb, Ta, Cr, Mo and W, M' is at least one element selected from the group consisting of Mn, elements of the platinum group, Ag, Au, Zn, Al, Ga, In, Sn, Cu and rare earth elements, A is at least one element selected from the group consisting of Co and Ni, Z is at least one element selected from the group consisting of B, C, P and Ge, and a, b, c, d, e and f are numbers respectively satisfy the relations: $0.1 \leqq a \leqq 5$, $0.1 \leqq b \leqq 10$, $0 \leqq c \leqq 10$, $0 \leqq d \leqq 40$, $5 \leqq e \leqq 25$, $2 \leqq f \leqq 20$, $12 \leqq e+f \leqq 30$, these subscript values indicating the atomic percent amounts of the constituent elements of the composition, wherein said alloy comprises an amorphous phase and fine crystal grains consisting essentially of a Fe-solid solution having a bcc structure and having an average diameter of 20 nm or less, said alloy having been prepared by completely fusing the composition of the formula above to form a melt, rapidly quenching the melt, and heat treating the rapidly quenched alloy to form said fine crystal grains.

10. The Fe-based soft magnetic alloy as set forth in claim 9, wherein said compound represented by X is at least one oxide selected from the group consisting of CuO, $Cu_2O$, $SnO_2$, $Bi_2O_3$, $MoO_3$, MnO, $GeO_2$, and CdO.

11. The Fe-based soft magnetic alloy as set forth in claim 9, wherein said compound has a density satisfying $0.6\ Da \leqq Dc \leqq 1.3Da$, provided that Dc is the density of X and Da is the density of the alloy composition except for X.

12. An Fe-based soft magnetic alloy consisting essentially of a composition having the formula:

$$Fe_{100-a-b-c-d-e-f}X_aM_bM'_cA_dSi_eZ_f$$

wherein X is at least one compound selected from the group consisting of CuO, $Cu_2O$, $SnO_2$, $Bi_2O_3$, $MoO_3$ and $GeO_2$ which is fusible when the composition is fused upon heating and rapidly quenched to form a rapidly quenched alloy, M is at least one element selected from the group consisting of Ti, Zr, Hf, V, Nb, Ta, Cr, Mo and W, M' is at least one element selected from the group consisting of Mn, elements of the platinum group, Ag, Au, Zn, Al, Ga, In, Sn, Cu and rare earth elements, A is at least one element selected from the group consisting of Co and Ni, Z is at least one element selected from the group consisting of B, C, P and Ge, and a, b, c, d, e and f respectively satisfy the relations: $0.1 \leqq a \leqq 5$, $0.1 \leqq b \leqq 10$, $0 \leqq c \leqq 10$, $0 \leqq d \leqq 40$, $5 \leqq e \leqq 25$, $2 \leqq f \leqq 20$, $12 \leqq e+f \leqq 30$, these subscript values indicating the atomic percent amounts of the constituent elements of the composition, wherein said alloy comprises an amorphous phase and fine crystal grains consisting essentially of a Fe-solid solution having a bcc structure and having an average diameter of 20 nm or less, said alloy having been prepared by completely fusing the composition of the formula above to form a melt, rapidly quenching the melt, and heat treating the rapidly quenched alloy to form said fine crystal grains.

13. A magnetic core in the shape of a wound core or a laminated care respectively made of the Fe-based soft magnetic alloy as set forth in claim 1.

14. A magnetic core in the shape of a compressed dust core made of the Fe-based soft magnetic alloy powder as set forth in claim 8.

* * * * *

UNITED STATES PATENT AND TRADEMARK OFFICE

CERTIFICATE OF CORRECTION

PATENT NO. : 5,522,948

DATED : June 4, 1996

INVENTOR(S) : Takao SAWA ET AL

It is certified that error appears in the above-identified patent and that said Letters Patent is hereby corrected as shown below:

In the title page, item [57], ABSTRACT, delete the Abstract in its entirety and replace with --An Fe-based soft magnetic alloy is consisted essentially of fine crystal grains constituting 50% or more of the alloy structure by area %. The Fe-based soft magnetic alloy has the composition substantially represented by the general formula: $Fe_{100-a-b-c-d-e-f}X_aM_bM'_cA_dSi_eZ_f$ (wherein X is at least one compound selected from the ceramic materials fusible when the composition is fused and rapidly quenched to form a rapidly cooled alloy, M is at least one element selected from the group consisting of Ti, Zr, Hf, V, Nb, Ta, Cr, Mo and W, M' is at least one element selected from the group consisting of Mn, elements in the platinum group, Ag, Au, Zn, Al, Ga, In, Sn, Cu and rare earth elements, A is at least one element selected from among Co and Ni, Z is at least one element selected from the group consisting of B, C, P and Ge. Said a, b, c, d, e and f respectively satisfy $0.1 \leq a \leq 5$, $0.1 \leq b \leq 10$, $0 \leq c \leq 10$, $0 \leq d \leq 40$, $5 \leq e \leq 25$, $2 \leq f \leq 20$, $12 \leq e+f \leq 30$, provided that all the numerals in the said formulae are in terms of atomic %). The inorganic compound represented by X of the above general formula makes the precipitating crystal grains super fine, thereby reducing dependence of the soft magnetic properties on the heat treatment temperature.--

UNITED STATES PATENT AND TRADEMARK OFFICE

CERTIFICATE OF CORRECTION

PATENT NO. : 5,522,948

DATED : June 4, 1996

INVENTOR(S) : Takao SAWA ET AL

It is certified that error appears in the above-identified patent and that said Letters Patent is hereby corrected as shown below:

Column 1, line 60, "constraction" should read --contraction--.

Column 2, line 2, "Since" should read --since--.
line 60, "In Sn" should read --In, Sn--.

Column 4, line 21, "Ta Cr Mo" should read --Ta, Cr, Mo--.
line 28, "arround" should read --around--.

Column 6, line 11, "precipating in the boundary of crystal" should read --precipitating in the clusters of crystal--.

Column 6, line 28, "made very smaller" should read --made smaller--.

Column 6, line 49, "a melt: is" should read --a melt is--.

Column 8, line 7, "gas atmosphere nitrogen" should read --gas atmosphere such as nitrogen--.

Column 8, line 8, "argon, vacuum, a reducing atmosphere" should read --argon, or a vacuum, or a reducing atmosphere--.

Column 9, line 13, "such epoxy" should read --such as an epoxy--.

UNITED STATES PATENT AND TRADEMARK OFFICE

CERTIFICATE OF CORRECTION

PATENT NO. : 5,522,948

DATED : June 4, 1996

INVENTOR(S) : Takao SAWA ET AL

Figure 3:
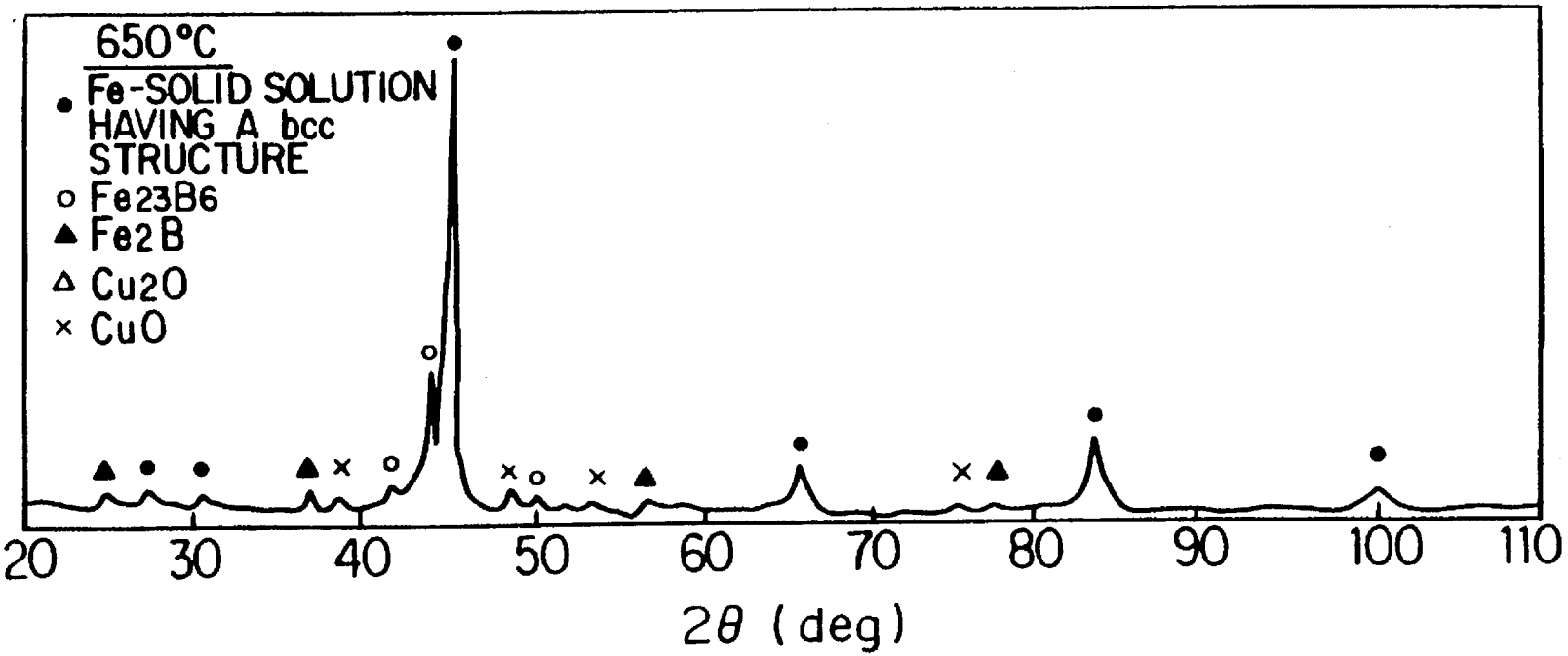
FIG. 3 is a graph showing an X-ray diffraction pattern of the alloy ribbon heat-treated at 650° C. with respect to one embodiment of the present invention.

It is certified that error appears in the above-identified patent and that said Letters Patent is hereby corrected as shown below:

Column 10, line 22, "shown FIG. 3." should read --shown in FIG. 3.--.

Column 10, line 47, "opimum" should read --optimum--.

Column 11, line 6, "CuO greater" should read --CuO was greater--.

Column 11, line 56, "obtained The" should read --obtained. The--.

Column 19, line 46, "a super lattice" should read --a superlattice--.

Column 19, line 56, "Cuo, CuO," should read --CuO, $Cu_2O$,--.

Column 19, line 63, "$Fe_{100-a-b-c-f}X_aM_bSi_cZ_f$." should read --$Fe_{100-a-b-c-d-e-f}X_aM_bSi_eZ_f$--.

Column 20, line 7, "$g+h \leq 10$," should read --$b+g+h \leq 10$,--.

Column 20, line 8, "atomic %)." should read --atomic %.--.

Column 20, line 29, "satisfy" should read --satisfying--.

Column 20, line 36, "prepared" should read --treated--.

UNITED STATES PATENT AND TRADEMARK OFFICE

CERTIFICATE OF CORRECTION

PATENT NO. : 5,522,948

DATED : June 4, 1996

INVENTOR(S) : Takao SAWA ET AL

It is certified that error appears in the above-identified patent and that said Letters Patent is hereby corrected as shown below:

Column 22, line 2, "laminated care" should read --laminated core--.

Signed and Sealed this

Twenty-first Day of July, 1998

Bruce Lehman

*Attest:*

BRUCE LEHMAN

*Attesting Officer*

*Commissioner of Patents and Trademarks*